United States Patent [19]

Gersbach

[11] B 3,982,171

[45] Sept. 21, 1976

[54] GATE CURRENT SOURCE

[75] Inventor: John Edwin Gersbach, Burlington, Vt.

[73] Assignee: International Business Machines Corporation, Armonk, N.Y.

[22] Filed: Jan. 2, 1974

[21] Appl. No.: 430,276

[44] Published under the second Trial Voluntary Protest Program on January 20, 1976 as document No. B 430,276.

[52] U.S. Cl. ..... 323/1; 323/4

[51] Int. Cl.[2] ..... G05F 3/08

[58] Field of Search ..... 307/296, 297; 323/1, 323/4, 16, 19

[56] References Cited

UNITED STATES PATENTS

| | | | |
|---|---|---|---|
| 3,348,162 | 10/1967 | Atkins | 330/28 |
| 3,566,158 | 2/1971 | Paine et al. | 323/16 UX |
| 3,681,623 | 8/1972 | Hoffman et al. | 323/4 X |
| 3,754,181 | 8/1973 | Kreitz et al. | 323/1 |

OTHER PUBLICATIONS

Dorler et al., T²L Controlled Current Source, IBM Technical Disclosure Bulletin, Vol. 15, No. 4, Sept. 1972, pp. 1102,1103.

Melnyk, Magnet Driver & Pulse-Width Controller, IBM Technical Disclosure Bulletin, Vol. 11, No. 4, Sept. 1968, p. 425.

*Primary Examiner*—A. D. Pellinen

*Attorney, Agent, or Firm*—Stephen J. Limanek

[57] ABSTRACT

A gated current source providing a fast rise time, minimal delay and improved output current tolerance utilizes a non-linear feedback loop between first and second transistors and an appropriate proportioning of resistances coupled to a collector electrode of one of the transistors. The first transistor has its emitter electrode connected to the base electrode of the second transistor and the collector electrode of the second transistor is coupled to the base electrode of the first transistor through a diode. An input pulse is applied to the base electrode of the first transistor through a first resistor and a second resistor having an impedance value relatively low compared with that of the first resistor is connected to the collector electrode of the second transistor. A third transistor, acting as a current sink, has its base electrode connected to the base electrode of the second transistor at which a reference voltage used as a control voltage is produced. A conventional voltage source is suitably coupled to each of the transistors.

6 Claims, 1 Drawing Figure

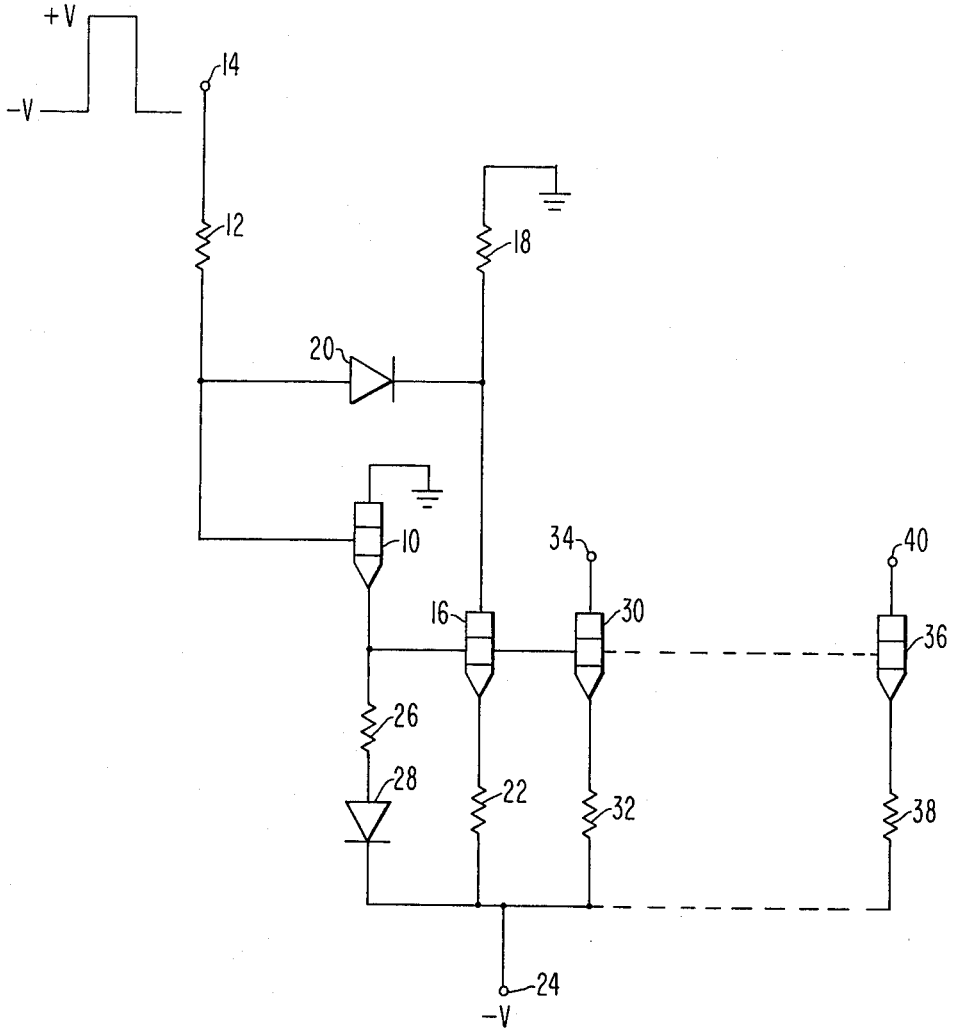
+V
-V
14
12
18
20
10
34
40
16
30
36
26
28
22
32
38
24
-V

GATE CURRENT SOURCE

FIELD OF THE INVENTION

This invention relates to electrical circuits for supplying a controlled magnitude of current from a voltage source to a load. When a constant current is desired a constant current means is interposed between a conventional power or voltage supply and the load. A constant current source may be provided by simply using a large resistor as the constant current means. Alternatively, a transistor, having its control or base electrode connected to a reference potential and with its collector electrode as the output may be utilized as the constant current means, the source impedance being the relatively large output resistance of the transistor.

DESCRIPTION OF THE PRIOR ART

Various regulated or constant current sources have been used for supplying a constant current to a load. One such source employs a constant voltage device, such as a zener diode, for producing a desired reference voltage to control the constant current, as disclosed in more detail in U.S. Pat. No. 3,114,872. Another type current source, described in U.S. Pat. No. 3,588,672, utilizes a junction device or diode connected serially with a transistor and a feedback arrangement for regulating the constant current. A current source which is gated to periodically provide constant current to one or more loads, such as to current switching circuits, is described in commonly assigned U.S. Pat. No. 3,736,574.

SUMMARY OF THE INVENTION

It is an object of this invention to provide an improved gated current source.

It is another object of this invention to provide a gated current source which has a fast rise time.

Yet another object of this invention is to provide a gated current source with less delay in output current.

A further object of the invention is to provide a gated current source wherein the output current tolerance is improved.

These and other objects of the invention are obtained by providing a gated current source having feedback means which include a non-linear impedance element for establishing a reference voltage as the control voltage for the constant current. In an embodiment of the invention, a first transistor has its emitter connected to the base of a second transistor with the collector of the second transistor being coupled to the base of the first transistor through a non-linear impedance. An input pulse is applied to the base of the first transistor through a first resistor and a second resistor having a relatively low resistance value is connected to the collector electrode of the second transistor. A third transistor, acting as a current sink for a load, such as a current switching load, has its base electrode connected to the base electrode of the second transistor at which the reference voltage is produced. A conventional voltage source is suitably coupled to each of the transitors.

The foregoing and other objects, features and advantages of the invention will be apparent from the following more particular description of the preferred embodiment of the invention, as illustrated in the accompanying drawing.

BRIEF DESCRIPTION OF THE DRAWING

In the drawing the FIGURE is a schematic diagram of the current source of the present invention.

DESCRIPTION OF THE PREFERRED EMBODIMENT

Referring to the drawing now in more detail, as shown in the FIGURE of the drawing, an embodiment of the gated current source of the present invention includes a first transistor 10 having its base electrode coupled through a first resistor 12 to a pulse source terminal 14. A second transistor 16 has its base electrode connected to the emitter electrode of the first transistor 10 and its collector coupled through a second resistor 18 to a point of reference potential, such as ground. A non-linear impedance device indicated as a diode 20 is connected between the collector electrode of the second transistor 16 and the base electrode of the first transistor 10. The emitter of the second transistor 16 is coupled through a third resistor 22 to a common return terminal 24 to which is connected a conventional power or voltage supply source having a substantially constant voltage indicated by −V. The emitter electrode of first transistor 10 is coupled to the common return terminal 24 through a fourth resistor 26 serially connected with a diode 28. The circuit described hereinabove including first and second transistors 10 and 16 and the elements coupled thereto forms a current reference circuit employing a non-linear feedback loop for producing at the base electrode of the second transistor 16 a regulated or reference voltage.

A third transistor 30 has its base electrode connected to the base electrode of the second transistor 16, its emitter electrode coupled through a fifth resistor 32 to the common return terminal 24 and its collector electrode connected to an output current terminal 34. The serially connected third transistor 30 and the fifth resistor 32 coupled to terminal 24 form a first current sink circuit to which may be coupled at terminal 34 a suitable load requiring a constant current, such as a conventional current switching arrangement (not shown). Additional current sink circuits, such as illustrated by fourth transistor 36, sixth resistor 38 and output current terminal 40 may be coupled, as required, to the gated current source of the present invention.

In the operation of the gated current source of the present invention, when a voltage −V is applied to the pulse source terminal 14, the transistors 10, 16, 30 and 36 are turned off and no current flows through the circuit of the invention. As the voltage at terminal 14 is increased toward +V, first transistor 10 turns on to produce a more positive voltage at its emitter electrode to turn on the second transistor 16 and likewise the third and fourth transistors 30 and 36 of the current sink circuits. Since the cathode of diode 20 is initially at ground potential and its anode is negative, the diode 20 represents a very high impedance or open circuit between the collector electrode of the second transistor 16 and the base electrode of the first transistor 10. Thus, all of the current flowing through the first resistor 12 is available to charge the base electrode of the first transistor 10. With the feedback loop between the collector electrode of the second transistor 16 and the base electrode of the first transistor 10 open, the reference voltage at the base of the transistors 16, 30 and 36 rises rapidly toward its final operating value at which the desired constant current through current sink circuits 30, 32 and 34, and 36, 38 and 40 is established. Without the high impedance in the feedback loop during the turn on or transient period much of the current passing through the first resistor 12 would become the collector current of the second transistor 16 and be unavailable to the base of the first transistor 10. As the collector current in the second transistor 16 increases, the voltage at the cathode of diode 20 becomes more negative, and as the pulse applied to the pulse source terminal 14 increases towards +V, the voltage at the anode of the diode 20 becomes more positive. The circuit parameters of the gated current source are arranged so that the diode 20 acts as a high impedance in the feedback loop during the transient period until the collector current of the second transistor 16 is at or near its desired final operating value. When the final collector current value of the second transistor 16 is realized, the impedance of diode 20 decreases and it now acts as a low impedance path in the feedback loop to maintain the desired constant current in the emitter-collector paths of transistors 16, 30 and 36 by controlling the reference voltage produced at the base electrode of the second transistor 16. It can be seen that, with the voltage at the pulse source terminal 14 at +V, if the voltage at the base electrode of the second transistor 16 tends to increase, i.e., become more positive, more collector current flows through the second transistor 16 to thereby apply a more negative voltage to the cathode of diode 20 which decreases the positive voltage on the base electrode of the first transistor 10 and thus the voltage at its emitter electrode. With a more negative voltage at the emitter electrode of the first transistor 10, the collector current of the second transistor 16 decreases, thus counteracting the tendency of the potential at the bases of transistors 16, 30 and 36 to increase. It can be seen, likewise, that if the voltage at the base electrode of the second transistor 16 tends to decrease, the feedback loop produces a more positive potential at the emitter electrode of the first transistor 10 to counteract the tendency of the potential at the bases of transistors 16, 30 and 36 to decrease.

In another aspect of this invention, the value of the second resistor 18 is low relative to the value of the first resistor 12 so that the collector current of the second transistor 16 is determined mainly by the value of the resistance of the second resistor 18 and thus it is relatively independent of the input voltage at the pulse source terminal 14, improving the output current tolerance.

Accordingly, it can be seen that an improved gated current source has been provided which has a fast rise time and a minimum delay in output current. This gated current source is particularly suitable for applying pulse power to current switching type circuits which are required, e.g., for support circuits, in monolithic semiconductor memory systems to provide reduced access and cycle times.

In an embodiment of the invention which operated satisfactorily, the resistance values were as follows: 4.5K ohms for first resistor 12, 1.2K ohms for second resistor 18, 100 ohms for third resistor 22, 200 ohms for fourth resistor 26, 100 ohms for fifth resistor 32, and 100 ohms for sixth resistor 38.

The voltage −V at the common return terminal 24 was equal to −3 volts. The voltage −V at pulse source terminal 14 was less than −2 volts and the voltage +V was equal to +0.8 volts. With the voltages at −V and then increasing to +V at pulse source terminal 14, the respective voltages at other points in the circuit of the invention were as follows: less than −2 volts to −1.2 volts at the base electrode of the first transistor 10; 0 volts to −2.0 volts at the collector electrode of the second transistor 16; and −2.6 volts to −2.0 volts at the base electrodes of transistors 16, 30 and 36.

As is well known, the constant current magnitudes in the current sink circuits 30, 32 and 34, and 36, 38 and 40 can be determined by the ratio of the resistances connected to the emitter electrodes of transistors 16, 30 and 36, that is the ratio of resistances of third resistor 22 to fifth resistor 32, third resistor 22 to sixth resistor 38, etc., so that different values of resistance may be substituted for the resistance of fifth resistor 32 and sixth resistor 38 depending upon the requirements of the current switching circuits or other load circuits coupled to output current terminals such as 34 and 40.

While the invention has been particularly shown and described with reference to a preferred embodiment thereof, it will be understood by those skilled in the art that various changes in form and details may be made therein without departing from the spirit and scope of the invention.

What is claimed is:

1. A current source comprising a current reference circuit, including a first transistor having a base electrode and an emitter electrode, a second transistor having a collector electrode, an emitter electrode and a base electrode coupled to the emitter electrode of said first transistor, a non-linear feedback circuit coupled between said collector electrode and the base electrode of said first transistor, an input terminal for receiving a voltage pulse coupled to the base electrode of said first transistor, a voltage supply source terminal and a first impedance coupling said voltage supply source terminal to the emitter electrode of said second transistor, and a current sink circuit, including an output current terminal, a second impedance and a third transistor having a collector electrode, an emitter electrode and a base electrode coupled to the base electrode of said second transistor, said collector electrode of said third transistor being connected to said output current terminal and said emitter electrode of said third transistor being connected to said voltage supply terminal through said second impedance.

2. A current source as set forth in claim 1 wherein said non-linear feedback circuit includes a diode.

3. A current source as set forth in claim 1 wherein said current reference circuit further includes a first resistor interposed between said input terminal and the base electrode of said first transistor.

4. A current source as set forth in claim 3 wherein said current reference circuit further includes a second resistor coupled to the collector electrode of said second transistor and having a low resistance value relative to that of said first resistor.

5. A gated current source comprising first, second and third transistors each having collector, base and emitter electrodes, a diode connected between the collector electrode of said second transistor and the base electrode of said first transistor, a first resistor, a first terminal means for receiving a voltage pulse coupled to the base electrode of said first transistor through said first resistor, a second resistor having a low resistance value relative to that of said first resistor, said second resistor being interposed between a point of reference potential and the collector electrode of said second transistor, a second terminal means for receiving a substantially constant voltage, first, second and third impedances, said first impedance being interposed between said second terminal means and the emitter electrode of said first transistor and the base electrode of said second transistor, said second impedance being interposed between said second terminal means and the emitter electrode of said second transistor and said third impedance being interposed between said second terminal means and the emitter electrode of said third transistor, and a third terminal means for receiving a constant output current, the collector electrode of said third transistor being connected to said third terminal means, the base electrodes of said second and third transistor being interconnected and the collector electrode of said first transistor being connected to a given point of reference potential.

6. A current source as set forth in claim 5 wherein said first impedance includes a third resistor and a second diode serially connected with said third resistor.

* * * * *